US012595969B2

(12) United States Patent
Sekti et al.

(10) Patent No.: US 12,595,969 B2
(45) Date of Patent: Apr. 7, 2026

(54) HEAT EXCHANGER FOR A MOTOR VEHICLE

(71) Applicant: VALEO KLIMASYSTEME GMBH, Bad Rodach (DE)

(72) Inventors: Condro Sekti, Bad Rodach (DE); Kamel Azzouz, Le Mesnil Saint Denis (FR)

(73) Assignee: VALEO KLIMASYSTEME GMBH, Bad Rodach (DE)

( * ) Notice: Subject to any disclaimer, the term of this patent is extended or adjusted under 35 U.S.C. 154(b) by 141 days.

(21) Appl. No.: 18/564,410

(22) PCT Filed: May 24, 2022

(86) PCT No.: PCT/EP2022/063989
§ 371 (c)(1),
(2) Date: Nov. 27, 2023

(87) PCT Pub. No.: WO2022/248441
PCT Pub. Date: Dec. 1, 2022

(65) Prior Publication Data

US 2024/0247874 A1 Jul. 25, 2024

(30) Foreign Application Priority Data

May 27, 2021 (DE) ..... 10 2021 113 750.0

(51) Int. Cl.
*F28D 9/00* (2006.01)
*F28D 21/00* (2006.01)

(52) U.S. Cl.
CPC ..... *F28D 9/005* (2013.01); *F28D 9/0056* (2013.01); *F28D 9/0093* (2013.01); *F28D 2021/0084* (2013.01); *F28F 2250/06* (2013.01)

(58) Field of Classification Search
CPC ..... F28D 9/005; F28D 9/0056; F28D 2021/0084; F28D 9/0093; F25B 39/04; F28F 2250/06
See application file for complete search history.

(56) References Cited

U.S. PATENT DOCUMENTS 4,872,578 A * 10/1989 Fuerschbach ..... F28D 9/005 165/166
5,810,071 A * 9/1998 Pavlin ..... F28D 9/005 123/196 AB (Continued)

FOREIGN PATENT DOCUMENTS

| | | |
|---|---|---|
| CN | 105431691 B | 1/2018 |
| FR | 3059400 A1 | 6/2018 |
| JP | 2021-014973 A | 2/2021 |

OTHER PUBLICATIONS

International Search Report and Written Opinion in corresponding International Application No. PCT/EP2022/063989, dated Sep. 8, 2022 (9 pages).

*Primary Examiner* — Jianying C Atkisson
*Assistant Examiner* — For K Ling
(74) *Attorney, Agent, or Firm* — Osha Bergman Watanabe & Burton LLP

(57) ABSTRACT

A heat exchanger for a motor vehicle is disclosed. The heat exchanger includes a core with a condenser section and a subcooling section. The core includes a liquid-coolant line and a refrigerant line separate from the liquid-coolant line. The refrigerant line extends from a refrigerant inlet to a refrigerant outlet via the condenser section and through the subcooling section. The heat exchanger includes a cover plate with a liquid-coolant inlet. The cover plate adjoins an end plate of the subcooling section and includes a depression. The depression is closed by the end plate to form a chamber on the side facing the end plate. The liquid-coolant (Continued)

Figure 1:
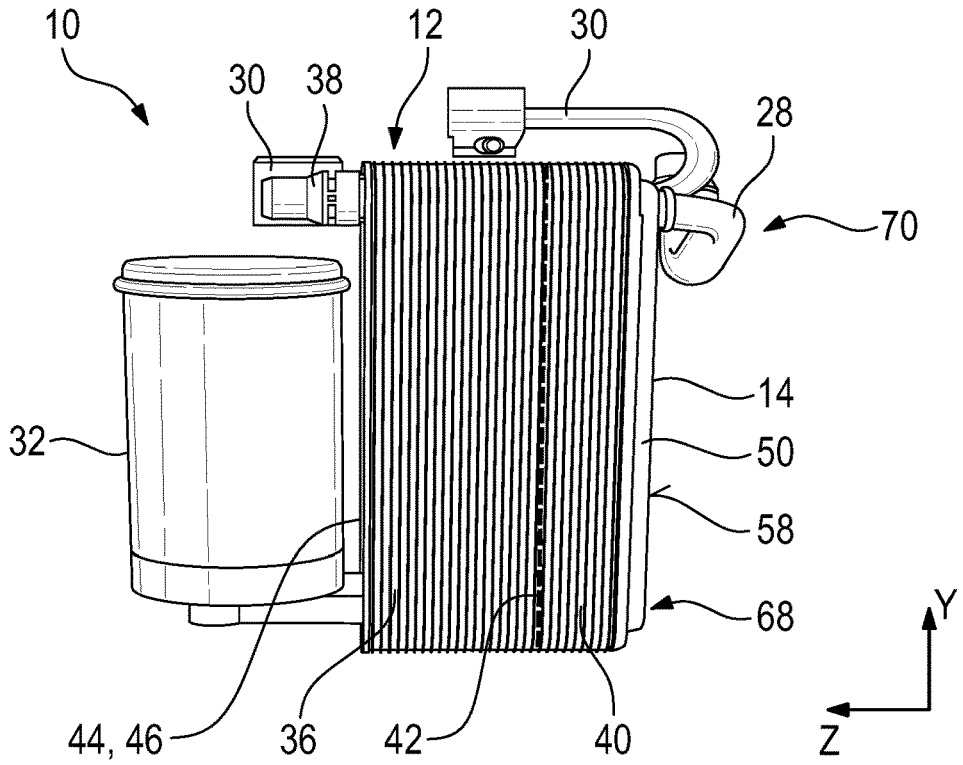

line extends from the liquid-coolant inlet to a collecting section of the core via a subcooling line and a bypass line.

12 Claims, 2 Drawing Sheets

(56) References Cited

U.S. PATENT DOCUMENTS

| | | | | |
|---|---|---|---|---|
| 5,964,283 | A * | 10/1999 | Pavlin | F28F 9/0253 123/196 AB |
| 7,469,554 | B2 * | 12/2008 | Martins | F28D 9/005 62/506 |
| 9,933,215 | B2 * | 4/2018 | Ollier | F28F 9/0075 |
| 9,951,998 | B2 * | 4/2018 | Bardeleben | F28F 9/0258 |
| 10,480,871 | B2 * | 11/2019 | Mueller | F28D 1/00 |
| 11,274,884 | B2 * | 3/2022 | Thomas | F28F 9/005 |
| 11,287,197 | B2 * | 3/2022 | Tonellato | F01M 5/007 |
| 11,747,096 | B2 * | 9/2023 | Augustyn | F28D 9/005 165/162 |
| 2010/0243200 | A1 * | 9/2010 | Baker, Jr. | F28D 9/005 165/41 |
| 2014/0224455 | A1 * | 8/2014 | Kalbacher | F28F 3/086 165/104.21 |
| 2016/0327318 | A1 * | 11/2016 | Kim | B60H 1/00342 |
| 2018/0135916 | A1 | 5/2018 | Sueyoshi et al. | |
| 2021/0033353 | A1 * | 2/2021 | Vandermeer | F28D 9/005 |

* cited by examiner

HEAT EXCHANGER FOR A MOTOR VEHICLE

The invention relates to a heat exchanger for a motor vehicle, comprising a core with a condenser section and a subcooling section. In this respect, the core has a liquid-coolant line and a refrigerant line, which is separate from the liquid-coolant line and extends from a refrigerant inlet to a refrigerant outlet via the condenser section and through the subcooling section.

Heat exchangers for motor vehicles are known.

Heat exchangers of this type, which are used for example for an air-conditioning system in the motor vehicle, usually consist of a core which in its interior defines a liquid-coolant line and a separate refrigerant line. During operation, a liquid coolant, for example cooling water, of a liquid-coolant circuit flows through the liquid-coolant line and a refrigerant of a refrigerant circuit flows through the refrigerant line, in order to exchange heat between the refrigerant and the liquid coolant.

In order to increase the efficiency of the exchange of heat and prolong the time in which the refrigerant and the liquid coolant can exchange heat with one another, the core is usually subdivided into multiple flow sections, with the result that the liquid-coolant line and the refrigerant line are lengthened.

It is disadvantageous in this respect that this configuration results in a comparatively large drop in pressure of the refrigerant and of the liquid coolant or in an increase in the volume and the mass of the heat exchanger.

It is an object of the invention to provide a heat exchanger for a motor vehicle that has a compact structure and results in a smaller drop in pressure.

The object is achieved by a heat exchanger for a motor vehicle that comprises a core with a condenser section and a subcooling section. The core also has a liquid-coolant line and a refrigerant line, which is separate from the liquid-coolant line and extends from a refrigerant inlet to a refrigerant outlet via the condenser section and through the subcooling section. The heat exchanger has a cover plate with a liquid-coolant inlet. In this respect, the cover plate adjoins an end plate of the subcooling section and has a depression, which is closed by the end plate so as to form a chamber, on the side facing the end plate. The liquid-coolant line extends from the liquid-coolant inlet to a collecting section of the core via a subcooling line through the subcooling section and, in parallel therewith, via a bypass line, formed by the chamber, past the subcooling section, and also from the collecting section to a liquid-coolant outlet via the condenser section. In this respect, the subcooling line and the bypass line lead into a common collecting line of the collecting section.

As a result of this configuration, during operation liquid coolant that has flowed via the subcooling line and liquid coolant that has flowed via the bypass line are mixed in the collecting section and flow through the collecting line together. The invention has found that in this way the drop in pressure in the liquid-coolant line can be reduced. The heat exchanger furthermore has an especially compact design by virtue of the specially configured cover plate. In particular, no pipe for the bypass line is necessary.

The heat exchanger is provided in particular for an air-conditioning system of a motor vehicle and is designed correspondingly.

In one embodiment, the cover plate extends over at least 90% of the surface area of an end face of the end plate of the subcooling section and can thus form a closure plate or end plate of the core. This further makes it possible to adapt the design of the cover plate to various cores having differently formed subcooling and/or collecting sections with low outlay, since essentially only the depression in the cover plate needs to be adapted correspondingly.

In addition or as an alternative, the depression may extend over at least 50% of the surface area of an end face of the cover plate and/or of an end face of the end plate. This makes it possible for the bypass line formed by the chamber to have a particularly large cross section and thus ensure a small drop in pressure in this section.

In a further embodiment, the collecting section is provided in a bottom region of the heat exchanger and the liquid-coolant inlet is provided in a top region of the heat exchanger. In other words, the collecting section and the liquid-coolant inlet are arranged at opposite ends of the core or of the heat exchanger. This has the advantage that the subcooling section and the bypass line can be arranged directly between the liquid-coolant inlet and the collecting section, as a result of which additional lines are not necessary and the heat exchanger can have an especially compact configuration.

It may be provided that the refrigerant outlet is arranged on an end face of the cover plate, with the result that no separate refrigerant outlet on the core is necessary.

In addition or as an alternative, the liquid-coolant inlet may be arranged on an end face of the cover plate. This has the advantage that the cover plate can be produced with low outlay.

According to a further embodiment, the liquid-coolant inlet is arranged in such a way and the subcooling line or the multiple subcooling lines and the bypass line are matched to one another such that between 40% and 60% of a liquid coolant flowing from the liquid-coolant inlet to the liquid-coolant outlet via the liquid-coolant line flows into the collecting section via the bypass line.

According to an alternative embodiment, the liquid-coolant inlet is arranged in such a way and the subcooling line(s) and the bypass line are matched to one another such that at most 20% or at least 80% of a liquid coolant flowing from the liquid-coolant inlet to the liquid-coolant outlet via the liquid-coolant line flows into the collecting section via the bypass line.

The core may also be configured in such a way that a liquid coolant flowing from the liquid-coolant inlet to the liquid-coolant outlet via the liquid-coolant line flows in the subcooling section and in the condenser section in the counterflow direction with respect to a refrigerant flowing from the refrigerant inlet to the refrigerant outlet via the refrigerant line. This configuration makes it possible for the heat exchanger to ensure especially efficient heat transfer and an especially high coefficient of performance, or COP.

It may furthermore be provided that the core is configured in such a way that a liquid coolant flowing from the liquid-coolant inlet to the liquid-coolant outlet via the liquid-coolant line flows in the subcooling section in the counterflow direction with respect to the condenser section, and/or a refrigerant flowing from the refrigerant inlet to the refrigerant outlet via the refrigerant line flows in the subcooling section in the counterflow direction with respect to the condenser section. As a result of this fluid or line guidance, also referred to as "U flow", the heat exchanger is especially compact and efficient heat transfer is ensured.

In one embodiment, the cover plate is a sheet-metal part shaped to form the depression and thus can be produced with especially low outlay.

It may further be provided that the cover plate forms a closure plate of the core, as a result of which the heat exchanger has an especially compact configuration.

As an alternative, the end plate may form a closure plate of the core. That is to say, the cover plate is an additional plate arranged on the closure plate of the core.

In a further embodiment, the distance between the bypass line and the subcooling line is smaller than the distance between the bypass line and the refrigerant line in the subcooling section. In other words, the subcooling line or the next section of the subcooling line is closer to the bypass line than the refrigerant line or the next section of the refrigerant line, respectively. This ensures that the liquid coolant flowing through the bypass line exchanges as little heat as possible in the bypass line with the refrigerant flowing through the refrigerant line in the subcooling section.

Figure 2:
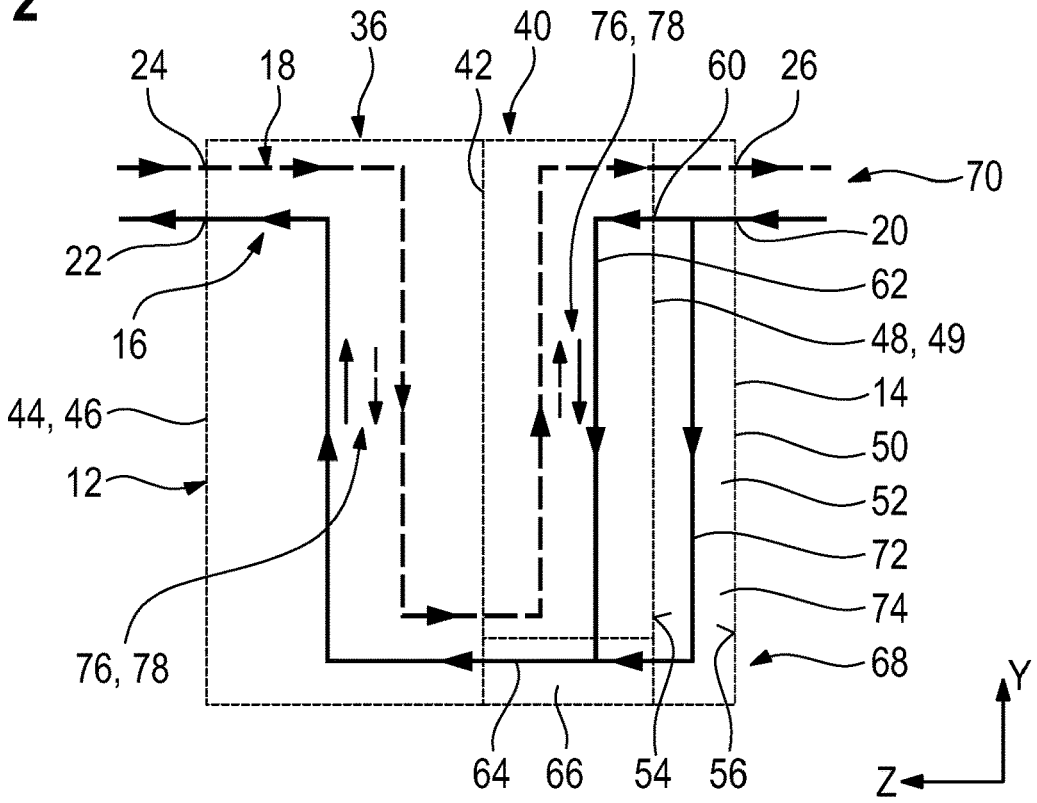
Figure 3:
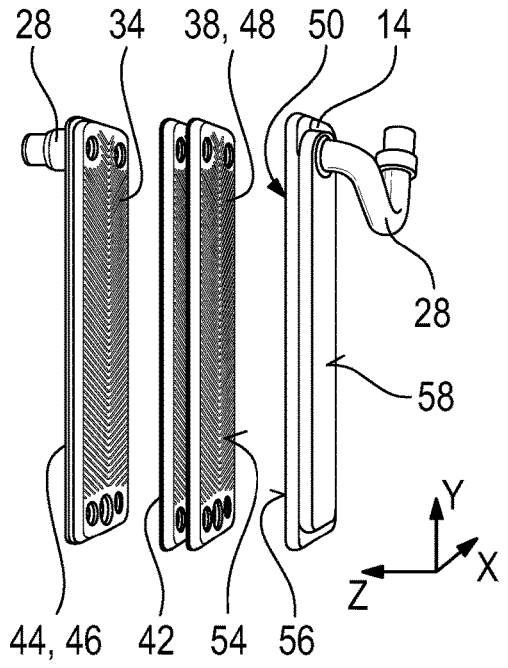
Figure 4:
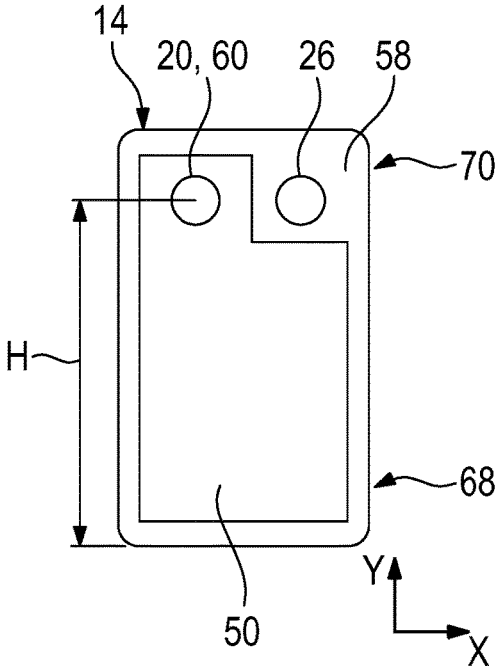
Figure 5:
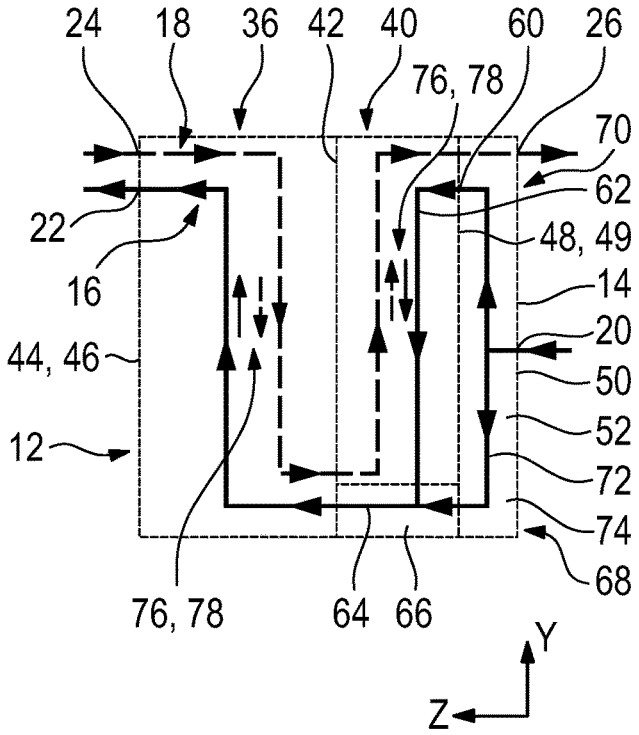
Figure 6:
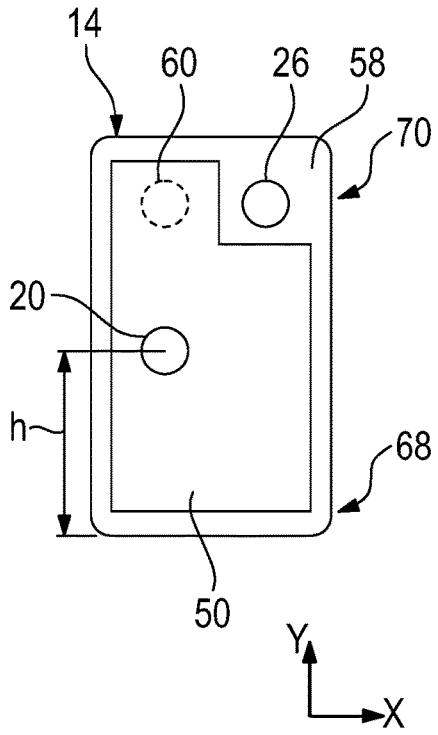

Further advantages and features will become apparent from the following description and from the appended drawings, in which:

FIG. 1 shows a perspective illustration of a heat exchanger according to the invention having a core and a cover plate, FIG. 2 shows a schematic illustration of a liquid-coolant line and a refrigerant line of the heat exchanger from FIG. 1, FIG. 3 shows an exploded illustration of different plates of the core and the cover plate of the heat exchanger from FIG. 1, FIG. 4 shows a schematic plan view of the cover plate of the heat exchanger from FIG. 1, FIG. 5 shows a schematic illustration of a liquid-coolant line and a refrigerant line of a heat exchanger in a further embodiment according to the invention, and FIG. 6 shows a schematic plan view of a cover plate of the heat exchanger from FIG. 5.

FIG. 1 shows a heat exchanger 10 for a motor vehicle that has a core 12 and a cover plate 14.

The heat exchanger 10 is a water-cooled condenser (WCC).

A liquid-coolant line 16 (see FIG. 2) and a refrigerant line 18 (illustrated in dashed lines in FIG. 2) of the heat exchanger 10, which are delimited and defined by the core 12 at least in certain sections, extend through the core 12 and the cover plate 14.

In this respect, the liquid-coolant line 16 runs from a liquid-coolant inlet 20 to a liquid-coolant outlet 22 of the heat exchanger 10, while the refrigerant line 18 extends from a refrigerant inlet 24 to a refrigerant outlet 26 of the heat exchanger 10.

The heat exchanger 10 also has liquid-coolant ports 28 and refrigerant ports 30, by means of which the heat exchanger 10 can be connected to a liquid-coolant circuit and a refrigerant circuit of the motor vehicle in order to connect the liquid-coolant line 16 via the liquid-coolant inlet 20 and the liquid-coolant outlet 22 to the liquid-coolant circuit in terms of flow, and also to connect the refrigerant line 18 via the refrigerant inlet 24 and the refrigerant outlet 26 to the refrigerant circuit in terms of flow.

The heat exchanger 10 also has a receiving container 32, which is connected to the refrigerant line 18 and is set up to receive refrigerant in a known way, in order to improve the performance of the heat exchanger 10.

The core 12 has multiple condensation plates 34 (see FIG. 3), which form a condenser section 36, and multiple subcooling plates 38, which form a subcooling section 40.

Furthermore, the core 12 has a separating plate 42, which separates the condenser section 36 from the subcooling section 40, and a base plate 44, which delimits the condenser section 36 oppositely to the separating plate 42 and forms a closure plate 46 of the core 12.

The subcooling section 40 directly adjoins the cover plate 14. In this respect, the subcooling plate 38, which is directly opposite the cover plate 14, forms an end plate 48 of the subcooling section 40.

In the present embodiment, the end plate 48 forms a further closure plate 49 of the core 12, which is arranged opposite the first closure plate 46.

In an alternative embodiment, the cover plate 14 itself can form the closure plate 49 of the core 12 and thus be part of the core 12.

The condensation plates 34 and the subcooling plates 38 may each have different configurations.

In particular, the end plate 48 has a different configuration to the subcooling plates 38, which are arranged between the end plate 48 and the separating plate 42.

In this context, the cover plate 14 has a depression 50, which is opposite the end plate 48 and together with the end plate 48 delimits a chamber 52 (see FIG. 2).

The base plate 44, the condensation plates 34, the separating plate 42, the subcooling plates 38 including the end plate 48, and the cover plate 14 are interconnected shaped sheet-metal parts arranged in a stack in the axial direction Z.

In the present exemplary embodiment, the depression 50 is formed by a bulge of the cover plate 14.

In principle, however, the depression 50 may be designed in any desired way, for example in the form of a recess.

Here, the cover plate 14 extends completely over an end face 54 (see FIG. 3) of the end plate 48.

In an alternative embodiment, the cover plate 14 may have any desired size, but preferably extends over at least 90% of the surface area of the end faces 54 of the end plate 48.

As illustrated in FIG. 4, the depression 50 extends over 75% of the surface area of an end face 56 (see FIG. 3) of the cover plate 14. In this respect, FIG. 4 shows the cover plate 14 in a plan view looking in the axial direction Z. This means that the end face 58 that has the bulge forming a correspondingly large depression 50 on the end face 56 and is opposite to the end face 56 can be seen in FIG. 4.

In an alternative embodiment, the depression 50 may extend over any desired proportion of the surface area of the end face 56 of the cover plate 14.

In particular, in one embodiment the depression 50 extends over at least 50% of the surface area of the end face 56 of the cover plate 14 and/or over at least 50% of the surface of the end face 54 of the end plate 48.

In the embodiment illustrated, the liquid-coolant inlet 20 and the refrigerant outlet 26 are arranged on the end face 58 of the cover plate 14 and extend in the axial direction Z through the cover plate 14.

Of course, in an alternative embodiment the liquid-coolant inlet 20 and/or the refrigerant outlet 26 may be arranged at any desired point on the cover plate 14 and configured as desired.

Furthermore, the refrigerant outlet 26 may be arranged directly on the end plate 48, in particular in embodiments in which the cover plate 14 does not extend completely over the end face 54 of the end plate 48.

With reference to FIG. 2, the course of the liquid-coolant line 16 and of the refrigerant line 18 will be explained below. Here, the arrows of the lines 16, 18 indicate the direction in which the liquid coolant flows through the liquid-coolant line 16 and the direction in which the refrigerant flows through the refrigerant line 18 during operation of the heat exchanger 10.

The liquid-coolant line 16 extends from the liquid-coolant inlet 20 through an opening 60 in the end plate 48 via a subcooling line 62 in the vertical direction Y through the subcooling section 40. The subcooling line 62 then leads into a collecting line 64, which is arranged in a collecting section 66 of the core 12.

Here, the collecting section 66 is arranged in a bottom region 68 of the core 12 that is arranged opposite a top region 70 of the core 12.

In the present embodiment, the liquid-coolant inlet 20, the liquid-coolant outlet 22, the refrigerant inlet 24 and the refrigerant outlet 26 are arranged in the top region 70.

Parallel to the subcooling line 62 extends a part of the liquid-coolant line 16 in the form of a bypass line 72, which is formed by the chamber 52, from the liquid-coolant inlet 20 past the subcooling section 40 in the vertical direction Y through a bypass section 74 into the collecting section 66, in which the bypass line 72 leads into the collecting line 64.

From the collecting line 64, the liquid-coolant line 16 extends in the vertical direction Y through the condenser section 36 to the liquid-coolant outlet 22.

The refrigerant line 18 extends from the refrigerant inlet 24 in the vertical direction Y through the condenser section 36 to the bottom region 68, and from there in the axial direction Z into the subcooling section 40 and in the vertical direction Y to the refrigerant outlet 26.

The liquid-coolant line 16 and the refrigerant line 18 thus each extend in a U shape through the core 12.

The receiving container 32 is connected, for example, to the refrigerant line 18 in the bottom region 68, i.e. refrigerant flowing through the refrigerant line 18 during operation flows from the condenser section 36 into the subcooling section 40 via the receiving container 32.

It should be pointed out at this juncture that the liquid-coolant line 16 and the refrigerant line 18 are illustrated merely schematically in FIG. 2. In particular, the illustration of the lines 16, 18 as a line does not mean that they have to be formed merely by a channel in the corresponding sections. In this context, the arrows 76, 78 indicate that, in particular in the condenser section 36 and in the subcooling section 40, the liquid-coolant line 16 and the refrigerant line 18 each have a multiplicity of channels through which the refrigerant and liquid coolant, respectively, flow in parallel during operation.

The liquid-coolant line 16 and the refrigerant line 18 are also configured such that the smallest distance between the bypass line 72 and the subcooling line 62 is smaller than the smallest distance between the bypass line 72 and the refrigerant line 18 in the subcooling section 40.

The heat exchanger 10 is set up to conduct liquid coolant and refrigerant in a counterflow arrangement through the core 12. This means that, during operation, the liquid coolant flows from the liquid-coolant inlet 20 to the liquid-coolant outlet 22 via the liquid-coolant line 16 and, in the process, flows in the subcooling section 40 and in the condenser section 36 in the opposite direction to the refrigerant flowing from the refrigerant inlet 24 to the refrigerant outlet 26 via the refrigerant line 18.

The heat exchanger 10 is also set up for the purpose of condensing the refrigerant in the condenser section 36 and subcooling or further cooling the refrigerant in the subcooling section 40 during operation of the heat exchanger 10.

On account of the bypass line 72, during operation only a portion of the liquid coolant flowing through the liquid-coolant inlet 20 flows via the subcooling section 40, while the other portion flows past the subcooling section 40 via the bypass line 72. In this way, the refrigerant in the subcooling section 40 is effectively cooled only by that portion of the liquid coolant that flows through the subcooling line 62, whereas, in the condenser section 36, the refrigerant is effectively cooled by all of the liquid coolant which, in the condenser section 36, consists of the mixture of the liquid coolant portion that has flowed via the bypass line 72 and the liquid coolant portion that has flowed via the subcooling line 62.

In the embodiments illustrated in FIGS. 1 to 4, the liquid-coolant inlet 20 is arranged at a height H in the vertical direction Y and also directly opposite the opening 60 in the axial direction Z. This arrangement of the liquid-coolant inlet 20 in combination with the configuration of the subcooling line 62 and the bypass line 72 leads to 80% of the liquid coolant that flows through the liquid-coolant inlet 20 flowing via the subcooling line 62 and 20% flowing via the bypass line 72 to the collecting line 64 during operation.

An alternative embodiment is illustrated in FIGS. 5 and 6. For the components known from the previous embodiments, the same reference signs are used and, in this respect, reference is made to the explanations above.

By contrast to the embodiments illustrated in FIGS. 1 to 4, the liquid-coolant inlet 20 is arranged at a height h in the vertical direction Y and also not directly opposite the opening 60.

This arrangement of the liquid-coolant inlet 20 in combination with the configuration of the subcooling line 62 and the bypass line 72 leads to 50% of the liquid coolant that flows through the liquid-coolant inlet 20 flowing via the subcooling line 62 and 50% flowing via the bypass line 72 to the collecting line 64 during operation.

Of course, the cover plate 14 in combination with the subcooling line 62 and the bypass line 72 may be configured and matched to one another such that any desired proportion flows via the bypass line 72, in particular at most 20%, 40% to 60%, or at least 80% of the liquid coolant flowing through the liquid-coolant inlet 20.

In this way, a heat exchanger 10 which has an especially high coefficient of power or COP is provided.

The heat exchanger 10 is also especially compact on account of the cover plate 14.

The configuration of the bypass line 72 and the merging of the subcooling line 62 and the bypass line 72 in the collecting line 64 ensure an especially favourable flow profile. As a result, the heat exchanger 10 has an especially small drop in pressure in the liquid-coolant line 16.

Tests have shown that the drop in pressure in the liquid-coolant line 16 can be reduced by more than 4% over a comparable heat exchanger from the prior art by virtue of the special configuration of the heat exchanger 10.

A further advantage is that the properties of the heat exchanger 10 can be adapted to various requirements with low outlay by virtue of the configuration of the cover plate 14 alone.

The invention is not restricted to the embodiments shown. In particular, individual features of one embodiment can be combined as desired with features of other embodiments, in particular independently of the other features of the corresponding embodiments.

The invention claimed is:

1. A heat exchanger for a motor vehicle, the heat exchanger comprising:

a core comprising a condenser section and a subcooling section; and a monolithic cover plate comprising a liquid-coolant inlet and a depression;

wherein the core comprises a liquid-coolant line and a refrigerant line separate from the liquid-coolant line;

wherein the refrigerant line extends from a refrigerant inlet to a refrigerant outlet via the condenser section and through the subcooling section;

wherein the monolithic cover plate adjoins an end plate of the subcooling section;

wherein the depression is enclosed by the end plate-so as to form a chamber, on the on a side facing the end plate;

wherein the liquid-coolant line extends from the liquid-coolant inlet to a collecting section of the core via a subcooling line and a bypass line;

wherein the subcooling line passes through the subcooling section;

wherein the bypass line:

is formed by the chamber, bypasses the subcooling section, and is located within and along the depression;

wherein the liquid-coolant line extends from the collecting section to a liquid-coolant outlet via the condenser section; and wherein the subcooling line and the bypass line lead into a common collecting line of the collecting section.

2. The heat exchanger according to claim 1, wherein the monolithic cover plate extends over at least 90% of a full surface area of an end face of the end plate.

3. The heat exchanger according to claim 1, wherein the depression extends over at least 50% of a full surface area of an end face of the monolithic cover plate and of an end face of the end plate.

4. The heat exchanger according to claim 1, wherein the collecting section is provided in a bottom region of the heat exchanger and the liquid-coolant inlet is provided in a top region of the heat exchanger.

5. The heat exchanger according to claim 1, wherein the refrigerant outlet and the liquid-coolant inlet are arranged on an end face of the monolithic cover plate.

6. The heat exchanger according to claim 1, wherein the liquid-coolant inlet is arranged in such a way and the subcooling line and the bypass line are matched to one another such that at between 40% and 60% of a liquid coolant flowing from the liquid-coolant inlet to the liquid-coolant outlet via the liquid-coolant line flows into the collecting section via the bypass line.

7. The heat exchanger according to claim 1, wherein the liquid-coolant inlet is arranged in such a way and the subcooling line and the bypass line are matched to one another such that either at most 20% or at least 80% of a liquid coolant flowing from the liquid-coolant inlet to the liquid-coolant outlet via the liquid-coolant line flows into the collecting section via the bypass line.

8. The heat exchanger according to claim 1, wherein the core is configured in such a way that a liquid coolant flowing from the liquid-coolant inlet to the liquid-coolant outlet via the liquid-coolant line flows in the subcooling section and in the condenser section in a counterflow direction with respect to a refrigerant flowing from the refrigerant inlet to the refrigerant outlet via the refrigerant line.

9. The heat exchanger according to claim 1, wherein the core is configured in such a way that a liquid coolant flowing from the liquid-coolant inlet to the liquid-coolant outlet via the liquid-coolant line flows in the subcooling section in a counterflow direction with respect to the condenser section, and a refrigerant flowing from the refrigerant inlet to the refrigerant outlet via the refrigerant line flows in the subcooling section in the counterflow direction with respect to the condenser section.

10. The heat exchanger according to claim 1, wherein the monolithic cover plate is a sheet-metal part shaped to form the depression.

11. The heat exchanger according to claim 1, wherein the monolithic cover plate or the end plate forms a closure plate of the core.

12. The heat exchanger according to claim 1, wherein a distance between the bypass line and the subcooling line is smaller than a distance between the bypass line and the refrigerant line in the subcooling section.

* * * * *